US010286264B2

(12) United States Patent
Yoshida

(10) Patent No.: US 10,286,264 B2
(45) Date of Patent: May 14, 2019

(54) GOLF CLUB SET WITH PROGRESSION OF CURVATURE OF SOLE AND CENTER OF GRAVITY

(71) Applicant: DUNLOP SPORTS CO. LTD., Kobe-shi, Hyogo (JP)

(72) Inventor: Makoto Yoshida, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/746,316

(22) Filed: Jun. 22, 2015

(65) Prior Publication Data

US 2015/0367207 A1 Dec. 24, 2015

(30) Foreign Application Priority Data

Jun. 23, 2014 (JP) ..... 2014-128123

(51) Int. Cl.
*A63B 53/04* (2015.01)
*A63B 53/00* (2015.01)

(52) U.S. Cl.
CPC .... *A63B 53/0466* (2013.01); *A63B 2053/005* (2013.01); *A63B 2053/0408* (2013.01); *A63B 2053/0433* (2013.01)

(58) Field of Classification Search
CPC ..... A63B 53/06; A63B 49/06; A63B 53/0466; A63B 59/0074
USPC ..... 473/328, 344, 345
See application file for complete search history.

(56) References Cited

U.S. PATENT DOCUMENTS 4,147,349 A * 4/1979 Jeghers ..... A63B 53/04 473/291
4,247,105 A * 1/1981 Jeghers ..... A63B 53/04 473/291
5,042,806 A * 8/1991 Helmstetter ..... A63B 53/02 473/311

(Continued)

FOREIGN PATENT DOCUMENTS

JP 60-210274 A 10/1985
JP 11-226157 A 8/1999
JP 2002-239036 A 8/2002

OTHER PUBLICATIONS

The Tutelman Site, Effects of Clubhead Features, http://www.tutelman.com/golf/design/head1.php, Aug. 2007.*

(Continued)

*Primary Examiner* — William M Pierce
(74) *Attorney, Agent, or Firm* — Birch, Stewart, Kolasch & Birch, LLP

(57) ABSTRACT

A golf club set includes golf clubs with different club numbers and loft angles. Each golf club head of golf clubs includes a crown portion, a face portion, and a sole portion. The sole portion includes a front region and a rear region, the front region being arranged on the face side, and the rear region being arranged on the back side. The front region has a flat front surface, and the rear region has a curved rear surface continuous with the front region. Among the golf clubs included in the golf club set, out of at least a pair of golf clubs having adjacent club numbers, the radius of curvature of the rear surface of the golf club having the higher club number is smaller than the radius of curvature of the rear surface of the golf club having the lower club number.

10 Claims, 4 Drawing Sheets

(56) References Cited

U.S. PATENT DOCUMENTS 5,288,079 A * 2/1994 Katayama ..... A63B 53/04 473/328
5,326,105 A * 7/1994 Fenton, Jr. ..... A63B 53/04 473/328
5,398,935 A * 3/1995 Katayama ..... A63B 53/04 473/324
5,482,280 A * 1/1996 Yamawaki ..... A63B 53/00 473/290
5,484,155 A * 1/1996 Yamawaki ..... A63B 53/04 473/242
5,547,188 A * 8/1996 Dumontier ..... A63B 53/04 473/287
6,093,112 A * 7/2000 Peters ..... A63B 53/00 473/291
6,402,639 B1 * 6/2002 Iwata ..... A63B 53/0466 473/330
6,482,104 B1 * 11/2002 Gilbert ..... A63B 53/04 473/287
6,623,374 B1 * 9/2003 Helmstetter ..... A63B 53/04 473/291
7,614,962 B1 * 11/2009 Clausen ..... A63B 53/047 473/291
7,762,905 B2 * 7/2010 Park ..... A63B 53/047 473/290
7,803,062 B2 * 9/2010 Gilbert ..... A63B 53/047 473/290
9,114,294 B2 * 8/2015 Clausen ..... A63B 53/06
2006/0178228 A1 * 8/2006 DiMarco ..... A63B 53/0466 473/334
2007/0054751 A1 * 3/2007 Breier ..... A63B 53/0466 473/334
2007/0178988 A1 * 8/2007 Tavares ..... A63B 53/04 473/334
2008/0058119 A1 * 3/2008 Soracco ..... A63B 53/04 473/350
2008/0102982 A1 * 5/2008 Wahl ..... A63B 53/047 473/335
2008/0146370 A1 * 6/2008 Beach ..... A63B 53/0466 473/336
2008/0194354 A1 * 8/2008 Nagai ..... A63B 53/0466 473/334
2009/0137339 A1 * 5/2009 Nakano ..... A63B 53/0475 473/350
2010/0041493 A1 * 2/2010 Clausen ..... A63B 53/047 473/291
2011/0009209 A1 * 1/2011 Llewellyn ..... A63B 53/0466 473/336
2012/0034991 A1 * 2/2012 Hartwell ..... A63B 53/047 473/290
2012/0064994 A1 * 3/2012 Wada ..... A63B 53/0466 473/346
2012/0071259 A1 * 3/2012 Clausen ..... A63B 53/047 473/290
2012/0157222 A1 * 6/2012 Kii ..... A63B 53/00 473/290
2012/0302367 A1 * 11/2012 Myrhum ..... A63B 53/0466 473/324
2013/0331201 A1 * 12/2013 Wahl ..... A63B 53/0475 473/329
2014/0073447 A1 * 3/2014 Golden ..... A63B 53/047 473/291
2015/0126296 A1 * 5/2015 Fossum ..... A63B 53/0466 473/290
2015/0217364 A1 * 8/2015 Zimmerman ..... B21K 17/00 72/352
2015/0297961 A1 * 10/2015 Voshall ..... A63B 53/06 473/335
2015/0321055 A1 * 11/2015 Golden ..... A63B 53/0466 473/338
2015/0328506 A1 * 11/2015 Morales ..... A63B 53/047 473/331
2016/0354653 A1 * 12/2016 Aramaki ..... A63B 53/0466

OTHER PUBLICATIONS

Total Cubfitting in the 21st Century, by Jeff Jackson and Jeff Summitt, Dynacraft Golf Products, Inc., pp. 27-59, 2001.*
Japanese Office Action, dated Mar. 20, 2018, for Japanese Application No. 2014-128123, along with an English translation.

* cited by examiner

GOLF CLUB SET WITH PROGRESSION OF CURVATURE OF SOLE AND CENTER OF GRAVITY

This application claims priorities to Japanese Patent Applications No. 2014-128123 filed on Jun. 23, 2014, which is hereby incorporated by reference in its entirety.

TECHNICAL FIELD

The present invention relates to a golf club and a golf club set.

BACKGROUND ART

A golf club disclosed in JP H11-226157A has a sole shaped such that the face angle is constant during addressing. More specifically, the sole is shaped such that there is a curvature in the toe-heel direction, the bounce angle increases toward the toe side, and the scoop angle increases toward the heel side. Accordingly, the orientation of the face is constant even if the lie angle changes during addressing.

SUMMARY OF INVENTION

However, the above-described golf club is designed giving consideration to only the face angle during addressing, and no consideration whatsoever is given to the characteristics of each club number. For example, with a high-number club, there are many cases of hitting the ball with poor lie, and in these cases, it is preferable for there to be little resistance when swinging the club through. For this reason, it is preferable for the sole portion to be curved. On the other hand, with a low-number club, there are many cases of hitting the ball off of a tee, and therefore it is not particularly a problem if there is large resistance when swinging the club through; in fact, if the sole portion is curved, the problem of difficulty in obtaining ball lift occurs due to not being able to stably place the club on the ground during addressing, and due to the club having a higher center of gravity.

The present invention was achieved in order to resolve the above-described issues, and an object thereof is to provide a golf club and a golf club set that, giving consideration to the characteristics of each club number, can reduce the club swing through resistance for a high-number club, and can stabilize addressing and lower the center of gravity for a low-number club.

A golf club according to the present invention is a golf club for inclusion in a golf club set having a plurality of golf clubs that have different club numbers and loft angles, the golf club including: a shaft; and a golf club head, wherein the golf club head includes a crown portion, a face portion, and a sole portion, the sole portion includes a front region and a rear region lined up along a face-back direction, the front region being arranged on a face side, and the rear region being arranged on a back side, the front region has a front surface formed so as to be flat along the face-back direction, the rear region has a rear surface formed so as to be curved along the face-back direction and be continuous with the front region, and among the plurality of golf clubs included in the golf club set, out of at least a pair of golf clubs having adjacent club numbers, a radius of curvature of the rear surface of the golf club having a higher club number is smaller than a radius of curvature of the rear surface of the golf club having a lower club number.

Note that the golf clubs making up the "golf club set" of the present invention are not necessarily required to be sold at the same time, and they may be sold individually. In other words, it is sufficient that the golf club set is recognized as a combination of golf clubs having different loft angles in at least the same series, and the golf club of the present invention need only be one of such golf clubs.

In the above golf club set, the length of the front region in the face-back direction may be in a range of 40% to 70% of the length of the sole portion in the face-back direction.

In the above golf club sets, club lengths of the plurality of golf clubs may be shorter the higher the club number is.

In any of the above golf club sets, among the plurality of golf clubs, the rear surface of at least the golf club having the lowest club number may be flat.

In any of the above golf club sets, the plurality of golf clubs may be wood-type golf clubs.

A golf club set according to the present invention is a golf club set including a plurality of golf clubs that have different club numbers and loft angles, wherein each of the golf clubs has a shaft and a golf club head, each of the golf club heads includes a crown portion, a face portion, and a sole portion, the sole portion includes a front region and a rear region lined up along a face-back direction, the front region being arranged on a face side, and the rear region being arranged on a back side, the front region has a front surface formed so as to be flat along the face-back direction, the rear region has a rear surface formed so as to be curved along the face-back direction and be continuous with the front region, and among the plurality of golf clubs, out of at least a pair of golf clubs having adjacent club numbers, a radius of curvature of the rear surface of the golf club having a higher club number is smaller than a radius of curvature of the rear surface of the golf club having a lower club number.

According to the present invention, the front region of the clubs of all club numbers has a flat front surface, thus making it possible to stably set the head when the sole portion has been set on the ground during addressing (i.e., it is possible to improve so-called "stability"). On the other hand, the rear region has a curved rear surface, thus making it possible to obtain effects such as the following.

For example, with a high-number club having a large loft angle, there are many cases of hitting the ball with poor lie, and therefore it is preferable for there to be little resistance when swinging the club through (i.e., it is preferable to have good turf interaction). In view of this, in the present invention, the higher the number of the club is, the lower the radius of curvature of the rear surface is reduced, and the higher the swing-through performance is increased as described above.

On the other hand, with a low-number club having a low loft angle, there are many cases of hitting the ball off of a tee unlike with a high-number club, and therefore there is not very much demand for swing-through performance. In view of this, with a low-number club, the radius of curvature of the rear surface is increased, thus lowering the center of gravity of the club. As a result, the club has a low center of gravity, and it is easier to obtain golf ball lift.

In any of the above golf club sets, the plurality of golf clubs may be wood-type golf clubs.

DESCRIPTION OF EMBODIMENTS

An embodiment of a golf club set according to the present invention will be described below with reference to the drawings. The golf clubs constituting the golf club set of the present embodiment are wood-type golf clubs (e.g., number 1 to 9 woods), and are different mainly in terms of not only the loft angle, but also the shape of the sole portion, as will be described later. The following describes one golf club first as an example, then an overview will be given for common structures, and then the shapes of the sole portions for the respective club numbers in the golf club set will be described in detail.

1. Overview of Golf Club Head

Figure 1:
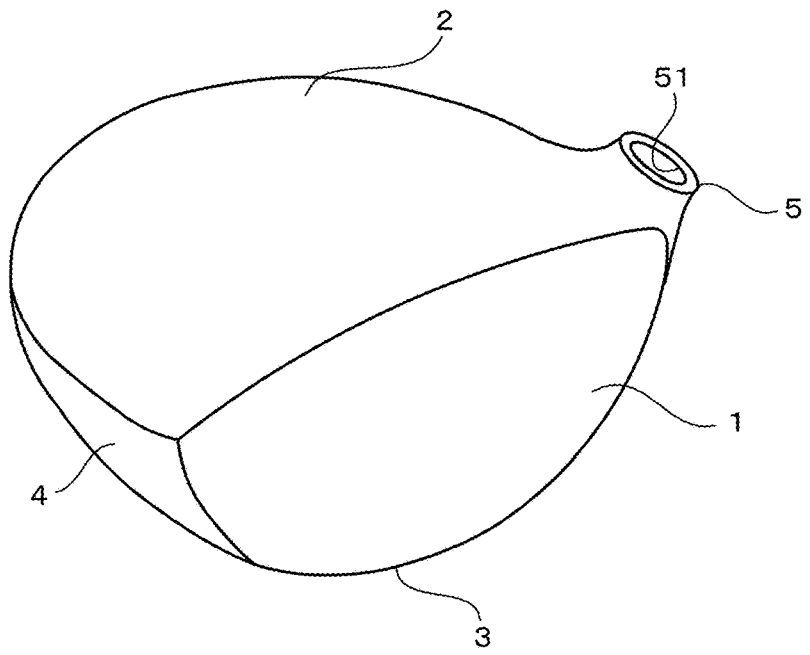
FIG. 1 is a perspective view of a reference state of one golf club head in a golf club set according to an embodiment of the present invention.
Figure 2:
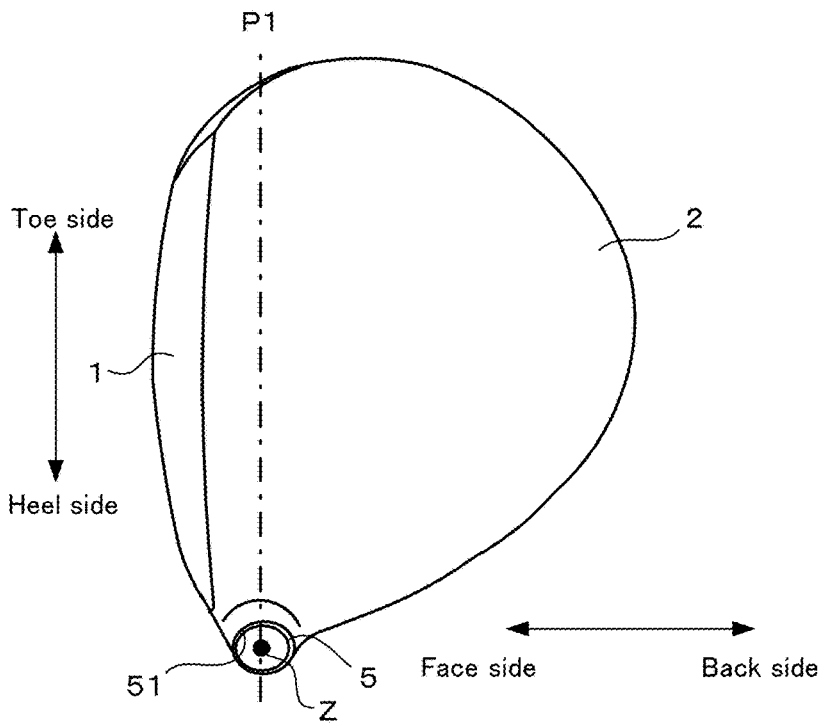
FIG. 2 is a plan view of FIG. 1.

First, the following takes the example of one golf club (#1 wood) in the golf club set of the present embodiment, and describes the golf club head of this golf club. FIG. 1 is a perspective view of the reference state of one golf club head in the golf club set of the present embodiment, and FIG. 2 is a plan view of FIG. 1. Note that the reference state of the golf club head will be described later.

As shown in FIG. 1, this golf club head (hereinafter sometimes simply referred to as the "head") is a hollow structure and has wall surfaces formed by a face portion 1, a crown portion 2, a sole portion 3, a side portion 4, and a hosel portion 5.

The face portion 1 has a face surface, which is the surface for hitting a ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the portion between the crown portion 2 and the sole portion 3, and extends from the toe side of the face portion 1, across the back side of the head, to the heel side of the face portion 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft.

The following describes the aforementioned reference state. First, as shown in FIGS. 1 and 2, the reference state is defined as a state in which the central axis Z is in a plane P1 that is perpendicular to the ground (horizontal plane), and furthermore the head is placed on the ground at a predetermined lie angle and real loft angle. The plane P1 will be referred to as the reference vertical plane. Also, as shown in FIG. 2, the direction of the line of intersection of the reference vertical plane P1 and the ground will be referred to as the toe-heel direction, and the direction that is perpendicular to the toe-heel direction and parallel to the ground will be referred to as the face-back direction. Note that in the golf club set of the present embodiment, the higher the number of the club is, the larger the loft angle is, similarly to ordinary golf club sets.

In the present embodiment, the boundary between the sole portion 3 and the face portion 1, and the boundary between the sole portion 3 and the side portion 4 can be defined as follows. Specifically, if ridge lines are formed between the sole portion 3 and the face portion 1, and between the sole portion 3 and the side portion 4, those ridge lines serve as the boundaries. Also, although the golf club head of the present embodiment has the side portion 4, in the case where the side portion 4 is not provided, and the sole portion 3 and the crown portion 2 are directly connected for example, the ridge line between the sole portion 3 and the crown portion 2 serves as the boundary between the two. Also, if a clear ridge line is not formed, the boundary is the outline that is seen when the head is placed in the reference state and viewed from directly above the center of gravity of the head.

Note that although an upper limit is not particularly defined for the head volume, practically it is, for example, desirably 500 $cm^3$ or less, or desirably 470 $cm^3$ or less when complying with R&A or USGA rules and regulations.

Also, the head can be formed from a titanium alloy having a specific gravity of approximately 4.4 to 4.5 (Ti-6Al-4V), for example. Besides a titanium alloy, the head can be formed from one or two or more materials selected from among stainless steel, maraging steel, an aluminum alloy, a magnesium alloy, an amorphous alloy, and the like.

Note that the head of the present embodiment is constituted by combining a head body that has at least the sole portion 3 with another portion. For example, a configuration is possible in which only the face portion 1 is constituted by another member, and the head is constituted by attaching the face portion 1 to the head body, and it is also possible to constitute a head by forming a head body in which an opening is provided in the crown portion 2 and the side portion 4, and blocking the opening with another member.

2. Sole Portion

Figure 3:
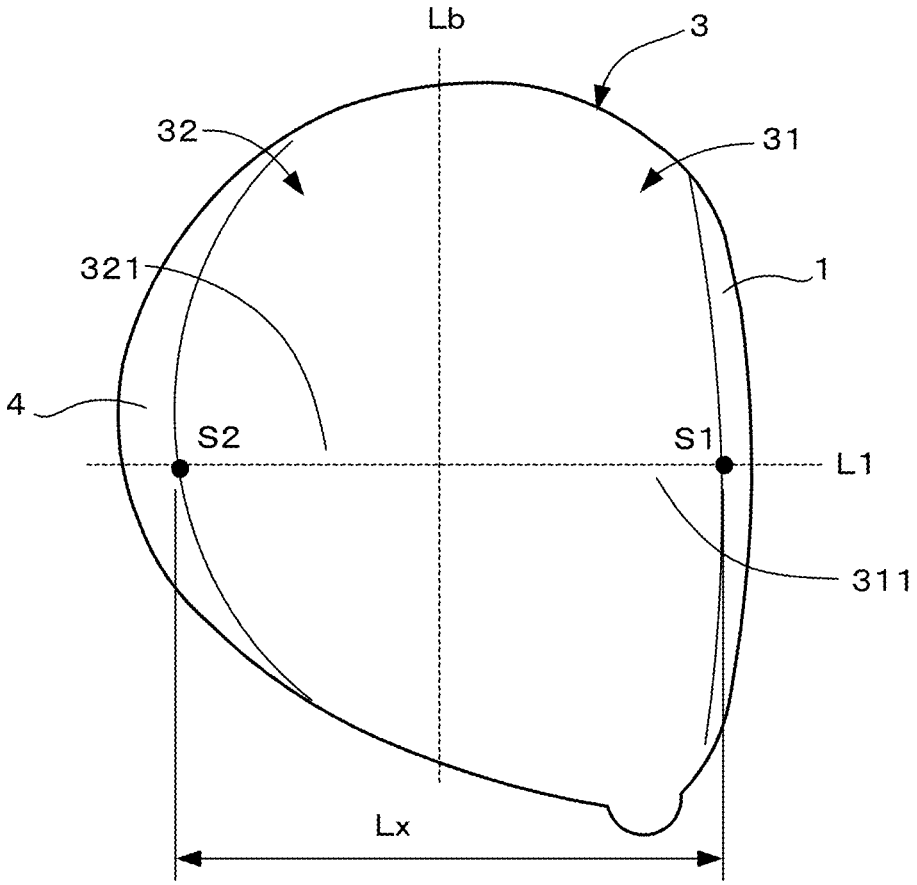
FIG. 3 is a bottom view of the golf club head of FIGS. 1 and 2 as viewed from below.
Figure 4:
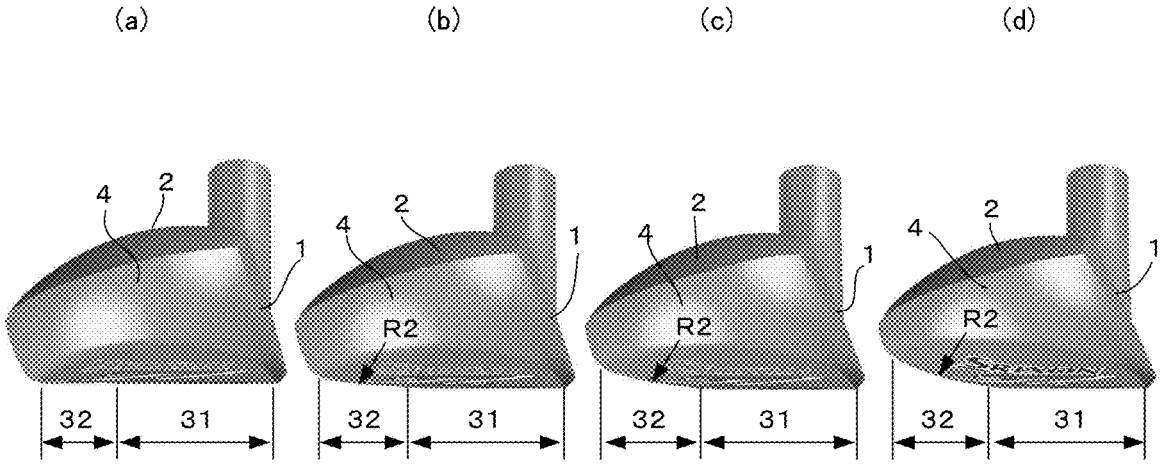
FIG. 4 is a side view of multiple golf club heads in the reference state.

Next, the sole portion 3 will be described with reference to FIGS. 3 and 4 as well. FIG. 3 is a bottom view of the golf club head of FIGS. 1 and 2 as viewed from below, and FIG. 4 is a side view of multiple golf club heads in the reference state. Note that FIG. 4 shows the heads of four golf clubs having adjacent club numbers in the golf club set of the present embodiment, and specifically a #2 wood (a), a #3 wood (b), a #4 wood (c), and a #5 wood (d) are lined up in the stated order from the left.

As shown in FIG. 3, the sole portion 3 of this head includes a front region 31 and a rear region 32, and these regions 31 and 32 are lined up in this order in the face-back direction. The boundary between the front region 31 and the rear region 32 can be set as follows, for example. First, a straight line that extends in the face-back direction and passes through the center of the face portion 1 in the toe-heel direction is projected on the sole portion 3, and this straight line will be referred to as a first reference line L1. In the following, the end of the first reference line L on the face portion 1 side of the sole portion 3 will be referred to as a front end point S1, and the end on the back side will be referred to as a rear end point S2. Also, the length of the sole portion 3 along the first reference line L1 will be referred to as a reference sole portion length Lx.

The front region 31 is the region making up 40 to 70% of the reference sole portion length Lx from the front end point S1, and the region rearward of the front region 31 is the rear region 32. Accordingly, the boundary between the front region 31 and the rear region 32 is a straight line extending in the toe-heel direction. Hereinafter, this straight line will be referred to as a reference boundary line Lb. Note that in one example, the reference boundary line Lb can be provided at a point 30 mm from the front end point.

Next, differences between the front region 31 and the rear region 32 will be described. Firstly, the front region 31 has a front surface 311 that at least includes the first reference line L1, and the first reference line L1 is flat on the front surface 311. Here, "flat" refers to a surface formed so as to have a radius of curvature of 30 inches or more, and a surface having a slight amount of curvature may be referred to as being flat. Note that in the case where the first reference line L is curved on the front surface 311, the radius of curvature thereof will be referred to as a first radius of curvature R1. Also, the front region 31 that includes the front surface 311 may be curved in the toe-heel direction for example, but the front surface 311 that at least includes the first reference line L1 is flat as described above.

On the other hand, the rear region 32 has a rear surface 321 that at least includes the first reference line L1, and the first reference line is curved on the rear surface 321. Specifically, the rear surface 321 is formed so as to draw a smooth and continuous arc from the first reference line L1 passing through the front region 31, and curves upward to the side portion 4 as it extends toward the back side. Note that on the rear surface 321, the radius of curvature of the first reference line L1 will be referred to as a second radius of curvature R2. Also, the rear region 32 that includes the rear surface 321 may be curved in the toe-heel direction for example, but the rear surface 321 that at least includes the first reference line L1 is curved in the face-back direction as described above. Note that the first radius of curvature R1 and the second radius of curvature R2 can be measured using an R gauge, for example.

Although the curvature of the first reference line L1 in the rear region 32 can be set in various ways, a configuration is possible in which the higher the number of the club is, that is to say the larger the loft angle is, the lower the second radius of curvature R2 on the rear surface 321 is set, as shown in FIG. 4. For example, the second radius of curvature R2 can be set smaller in a stepwise manner from flat to 0.5 inches for the #1 wood (driver), the #2 wood, the #3 wood, the #4 wood, and the #5 wood. The following shows one example of this.

TABLE 1

| Number | #1 wood | #2 wood | #3 wood | #4 wood | #5 wood |
|---|---|---|---|---|---|
| Front region | Flat | Flat | Flat | Flat | Flat |
| 2nd radius of curvature in rear region | Flat | Flat | 6 inches | 3.3 inches | 2.3 inches |

3. Features

As described above, according to the present embodiment, the front region 31 of the clubs of all club numbers has the flat front surface 311, thus making it possible to stably set the head when the sole portion 3 has been set on the ground during addressing (i.e., it is possible to improve so-called "stability"). On the other hand, the rear region 32 has the curved rear surface 321, thus making it possible to obtain effects such as the following.

For example, with a high-number club having a large loft angle, there are many cases of hitting the ball with poor lie, and therefore it is preferable for there to be little resistance when swinging the club through (i.e., it is preferable to have good turf interaction). In view of this, in the present embodiment, the higher the number of the club is, the lower the second radius of curvature R2 of the rear surface 321 is reduced, and the higher the swing-through performance is increased as described above.

On the other hand, with a low-number club having a low loft angle, there are many cases of hitting the ball off of a tee unlike with a high-number club, and therefore there is not very much demand for swing-through performance. In view of this, with a low-number club, the second radius of curvature R2 of the rear surface 321 is increased, thus lowering the center of gravity of the club. As a result, the club has a low center of gravity, and it is easier to obtain golf ball lift.

Also, the club length can be set differently according to the club number. Specifically, a configuration is possible in which the higher the club number is and the larger the loft angle is, the shorter the club length is set. This can obtain effects such as the following. For example, with a high-number club, the club length is short, and therefore the swing radius, whose circumference is the trajectory followed by the head, decreases. For this reason, the smaller the swing radius of the club is, the smaller the second radius of curvature R2 is, and therefore the higher the swing-through performance is. Note that the club length refers to the length measured based on the description in "Appendix II–DESIGN OF CLUBS" of the Rules of Golf stipulated by R&A.

4. Variations

Although an embodiment of the present invention has been described above, the present invention is not limited to this embodiment, and various modifications can be made without departing from the gist of the invention. The following are examples of modifications that can be made.

4.1

Figure 5:
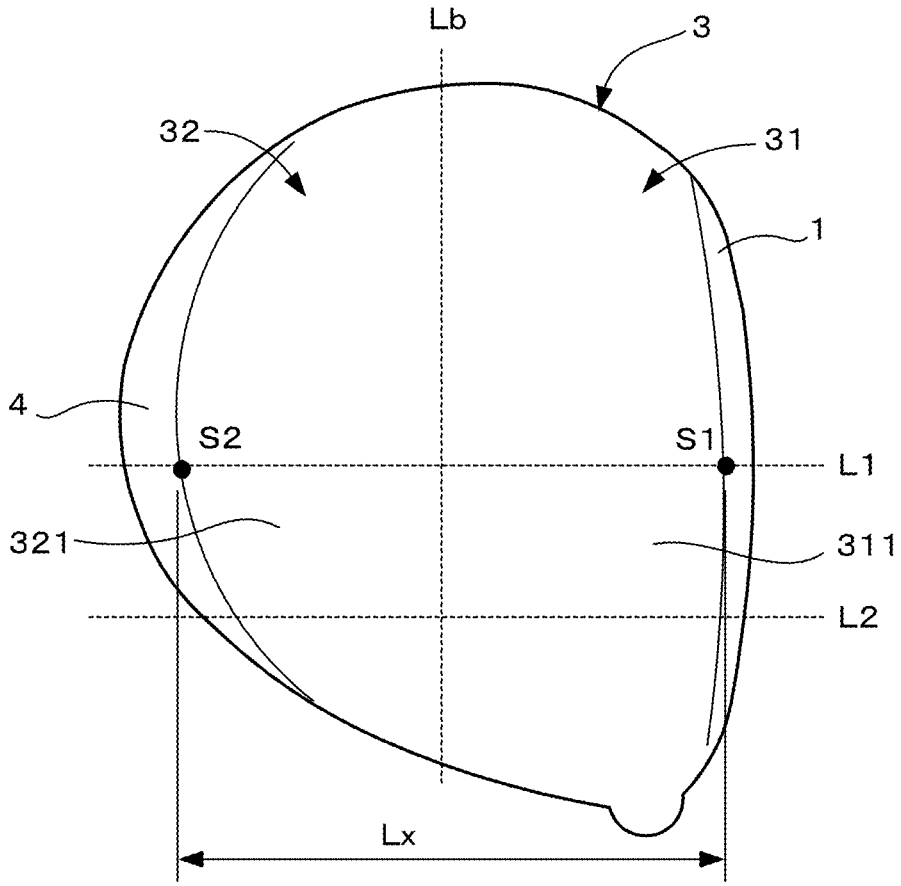
FIG. 5 is a bottom view of another example of FIG. 3.

In the above embodiment, the first reference line L1 is defined in the sole portion 3, and the front surface and the rear surface that include at least the first reference line L1 are described. However, there are also other methods for defining the front surface 311 and the rear surface 321. For example, as shown in FIG. 5, a second reference line L2 that is parallel with the first reference line L1 can be defined at a position shifted (e.g., 0 to 60 mm) toward the heel side from the first reference line L1. Regions between the first reference line L1 and the second reference line L2 are defined as the front surface 311 and the rear surface 321. If the front surface 311 is provided on the heel side in this way, it is possible to further improve stability when the head has been set on the ground during addressing. Note that there are no particular limitations on the positions where the front surface 311 and the rear surface 321 are provided, and it is sufficient that they at least include the first reference line L1.

4.2

In the above embodiment, in particular, as the club number increases, the second radius of curvature R2 decreases, but the second radius of curvature R2 is not necessary required to change in the club number order in the golf club set. Specifically, it is sufficient that the second radius of curvature R2 changes between at least one pair of adjacent club numbers in the golf club set. For example, the second radius of curvature R2 of the #4 wood is set smaller than the second radius of curvature R2 of the #3 wood. It is possible for the second radius of curvature R2 of all of the clubs lower than #3 to be set the same as that of the #3 wood, and for the second radius of curvature R2 of all of the clubs higher than #4 to be set the same as that of the #4 wood.

4.3

Also, the low-number clubs, including the club with the lowest club number, can be given a flat rear surface as described above, but even in the case of the club with the lowest club number, the rear surface may be curved. Note that it is to be understood that a flat rear surface has a higher radius of curvature than a curved rear surface. This is because a surface becomes flat as the radius of curvature thereof rises to infinity.

4.4

Also, although the front surface 311 and the rear surface 321 (particularly the rear surface 321) are constituted by a curved surface having one radius of curvature in the above embodiment, they can be a combination of curved surfaces that have different radiuses of curvature and are lined up along the face-back direction. In this case, the second radius of curvature R2 refers to the average value of the radiuses of curvature of the curved surfaces.

4.5

Although a wood-type golf club and a golf club set including clubs of this type are described in the above embodiment, the golf club and the golf club set of the present invention are not limited in this way. For example, the golf club set may include so-called utility-type clubs, hybrid-type clubs, or other types of clubs.

REFERENCE SIGNS LIST

1 Face portion
2 Crown portion
3 Sole portion
31 Front region
32 Rear region
311 Front surface
321 Rear surface

The invention claimed is:

1. A golf club set comprising a plurality of golf clubs,
wherein each of the golf clubs has a shaft and a golf club head,
wherein each of the golf club heads includes a crown portion, a face portion, and a sole portion,
wherein the sole portion of each golf club head includes a front region and a rear region lined up along a face-back direction, the front region being arranged on a face side, and the rear region being arranged on a back side,
wherein the front region of each golf club head has a front surface formed so as to be flat along the face-back direction,
wherein the rear region of each golf club head has a rear surface formed so as to be curved or flat along the face-back direction and be continuous with the front region, and
wherein the plurality of golf clubs includes at least a first golf club and a second golf club,
wherein the first golf club includes:
a radius of curvature of the rear surface that is smaller than a radius of curvature of the rear surface of the second golf club,
a center of gravity that is higher than a center of gravity of the second golf club, and
a loft angle that is higher than a loft angle of the second golf club,
wherein for each golf club, the length of the front region in the face-back direction is in a range of 40% to 70% of the length of the sole portion in the face-back direction, and
wherein for each golf club, the front surface extends from the end of the sole portion in the face side.

2. The golf club set according to claim 1, wherein for each golf club of the plurality of golf clubs:
the golf club head is a hollow structure and has a side portion and a hosel portion,
the face portion has a face surface, which is the surface for hitting a ball,
the crown portion is adjacent to the face portion and is configured to be an upper surface of the golf club head,
the sole portion is configured to be a bottom surface of the golf club head, and is adjacent to the face portion and the side portion,
the side portion is the portion between the crown portion and the sole portion, and extends from the toe side of the face portion, across the back side of the golf club head, to a heel side of the face portion, and
the hosel portion is the portion provided adjacent to a heel side of the crown portion, and has an insertion hole for the insertion of the shaft.

3. The golf club set according to claim 1, wherein the second golf club is shorter than the first golf club.

4. The golf club set according to claim 3, wherein among the plurality of golf clubs, the rear surface of at least the golf club having the greatest length is flat.

5. The golf club set according to claim 1, wherein each of the golf club head has a hosel portion, the hosel portion has an insertion hole for the insertion of the shaft.

6. The golf club set according to claim 1, wherein for each golf club:
the front surface and the rear surface are formed in between a first reference line and a second reference line,
the first reference line extends in the face-back direction and passes through a center of the face portion in a toe-heel direction is projected on the sole portion, and
the second reference line is parallel with the first reference line and is defined at a position shifted toward a heel side from the first reference line.

7. The golf club set according to claim 1, wherein the rear surface of the first golf club head and second golf club head is flat.

8. The golf club set according to claim 7, wherein the plurality of golf clubs further includes a third golf club, a fourth golf club and a fifth golf club,
wherein a rear surface of the third golf club head has a radius of curvature of 6 inches,
wherein a rear surface of the fourth golf club head has a radius of curvature of 3.3 inches, and
wherein a rear surface of the fifth golf club head has a radius of curvature of 2.3 inches.

9. The golf club set according to claim 4, wherein the rear surface of the first golf club head and second golf club head is flat.

10. The golf club set according to claim 9 wherein the plurality of golf clubs further includes a third golf club, a fourth golf club and a fifth golf club,
wherein a rear surface of the third golf club head has a radius of curvature of 6 inches,
wherein a rear surface of the fourth golf club head has a radius of curvature of 3.3 inches, and
wherein a rear surface of the fifth golf club head has a radius of curvature of 2.3 inches.

* * * * *